US008760062B2

(12) United States Patent
Shin

(10) Patent No.: US 8,760,062 B2
(45) Date of Patent: Jun. 24, 2014

(54) CIRCUIT AND METHOD OF DRIVING LIGHT EMITTING DIODES

(71) Applicant: LG Display Co., Ltd., Seoul (KR)

(72) Inventor: Sun kyung Shin, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 67 days.

(21) Appl. No.: 13/672,927

(22) Filed: Nov. 9, 2012

(65) Prior Publication Data

US 2013/0119876 A1 May 16, 2013

(30) Foreign Application Priority Data

Nov. 15, 2011 (KR) ..... 10-2011-0119177

(51) Int. Cl.
*H05B 37/02* (2006.01)
*H05B 33/08* (2006.01)

(52) U.S. Cl.
CPC ..... *H05B 37/02* (2013.01); *H05B 33/0827* (2013.01)
USPC ..... 315/186; 315/297

(58) Field of Classification Search
CPC .. H05B 37/02; H05B 33/0827; H05B 33/815; H05B 33/0851
USPC ..... 315/185 R, 186, 153, 287, 294, 297, 307
See application file for complete search history.

(56) References Cited

U.S. PATENT DOCUMENTS

| | | | | |
|---|---|---|---|---|
| 8,072,153 | B2 * | 12/2011 | Liu | 315/185 R |
| 8,169,161 | B2 * | 5/2012 | Szczeszynski et al. | 315/308 |
| 8,653,756 | B2 * | 2/2014 | Szczeszynski et al. | 315/308 |
| 2011/0234122 | A1 * | 9/2011 | Yu et al. | 315/297 |
| 2011/0267375 | A1 * | 11/2011 | Yang et al. | 345/690 |
| 2011/0285311 | A1 * | 11/2011 | Yang et al. | 315/291 |
| 2012/0049745 | A1 * | 3/2012 | Li et al. | 315/153 |
| 2012/0119673 | A1 * | 5/2012 | Wen et al. | 315/294 |
| 2013/0140990 | A1 * | 6/2013 | Campos et al. | 315/120 |

* cited by examiner

*Primary Examiner* — Don Le
(74) *Attorney, Agent, or Firm* — Morgan, Lewis & Bockius LLP

(57) ABSTRACT

An LED drive method is disclosed. In this way, the LED drive method allows not only the reference voltage to be periodically updated on the basis of the feedback drive voltages but also the drive voltage control signal to be generated using the updated reference voltage, in order to adjust the LED drive voltage applied to the LED array. Therefore, the LED drive circuit is hardly affected by the external environmental noise.

11 Claims, 6 Drawing Sheets

CIRCUIT AND METHOD OF DRIVING LIGHT EMITTING DIODES

The present application claims priority under 35 U.S.C. §119(a) of Korean Patent Application No. 10-2011-0119177 filed on Nov. 15, 2011, which is hereby incorporated by reference in its entirety.

BACKGROUND

1. Field of the Disclosure

The present application relates to light-emitting diode drive circuit and method.

2. Description of the Related Art

Recently, a variety of light-emitting technologies are being researched in display device field, in order to meet customer's demands for eco-friendly and low power products.

The currently used display devices include plasma display devices, liquid crystal display (LCD) devices, light-emitting diode (LED) display devices and so on. Among the display devices, the LED display devices are self-illuminating display devices each configured to drive a voltage between both electrodes. The LED display devices are spotlighted as next generation display devices because of having features such as stability, less heat generation and low power consumption. Such LED display devices have been used for illumination devices and backlight units of the LCD devices.

An LED drive circuit of the related art includes an LED array configured to include a plurality of parallel connected LED strings, constant current drivers disposed at the respective LED strings, and a system controller configured to control the operation of the LED array. Each of the LED strings includes a plurality of serially connected LEDs.

In general, a fixed reference voltage is applied to the system controller. The system controller compares the least drive voltage among drive voltages measured in the LED strings with the fixed reference voltage and controls the LED array based on the compared resultant.

If the least drive voltage among the drive voltage measured in the LED array is lower than the fixed reference voltage, the system controller raises the drive voltage. On the contrary, when the least drive voltage among the drive voltages measured in the LED array is higher than the fixed reference voltage, the system controller lowers the drive voltage which is used to drive the LED array.

However, the plurality of LED strings within the LED array is connected parallel to one another. Also, signals on each of the LED strings are often distorted due to external environment. The related art LED drive circuit controlling the drive voltage based on the fixed reference must have vulnerabilities to the external environment.

In other words, external noise components can be input to each of the LED strings. As such, the measured drive voltages must include the noise components. Nevertheless, the drive voltage is adjusted through the comparison of the measured drive voltage and the fixed reference voltage without considering the noise components. Due to this, the related art LED drive circuit must be easily affected by the external environment.

BRIEF SUMMARY

Accordingly, embodiments of the present application are directed to LED drive circuit and method that substantially obviate one or more of problems due to the limitations and disadvantages of the related art.

The embodiments are to provide LED drive circuit and method that are hardly affected by the external environmental noise by periodically updating a reference voltage and generating a drive voltage control signal, which is used to adjust an LED drive voltage applied to an LED array, using the updated reference voltage.

Also, the embodiments are to provide LED drive circuit and method that are adapted to provide stable operation regardless of the external environmental noise by generating a drive voltage control signal in a state that sampling time points for a feedback drive voltage from each LED string within an LED array are irregularly set.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to a first general aspect of the present embodiment, an LED drive circuit includes: an LED array configured to include LED strings which each include a plurality of serially connected LEDs; a power supplier configured to apply a drive voltage to the LED array; current drivers connected to the respective LED strings and configured to control current signals flowing along the respective LED strings in response to a first control signal including LED current information; and a main controller configured to irregularly input each feedback drive voltage from the LED strings and generate a second control signal which is used to adjust to the drive voltage applied from the power supplier to the LED array.

An LED drive method according to a second general aspect of the present embodiment is applied to an LED drive circuit which includes an LED array configured to include LED strings each having a plurality of serially connected LEDs, a power supplier configured to apply a drive voltage to the LED array, and current drivers connected to the respective LED strings and configured to control current signals flowing along the respective LED strings in response to a first control signal including LED current information. The method includes: measuring multiple times a feedback drive voltage from each of the light-emitting diode strings in irregular intervals; calculating an average value of the measured multiple signals for each of the feedback drive voltages to generate average values of the feedback drive voltages; periodically updating a reference voltage using the average values of the feedback drive voltages applied from the median filter; and generating a second control signal, which is used to adjust the drive voltage being applied from the power supplier to the light-emitting diode array, using the updated reference voltage and the average values of the digital feedback drive voltages.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
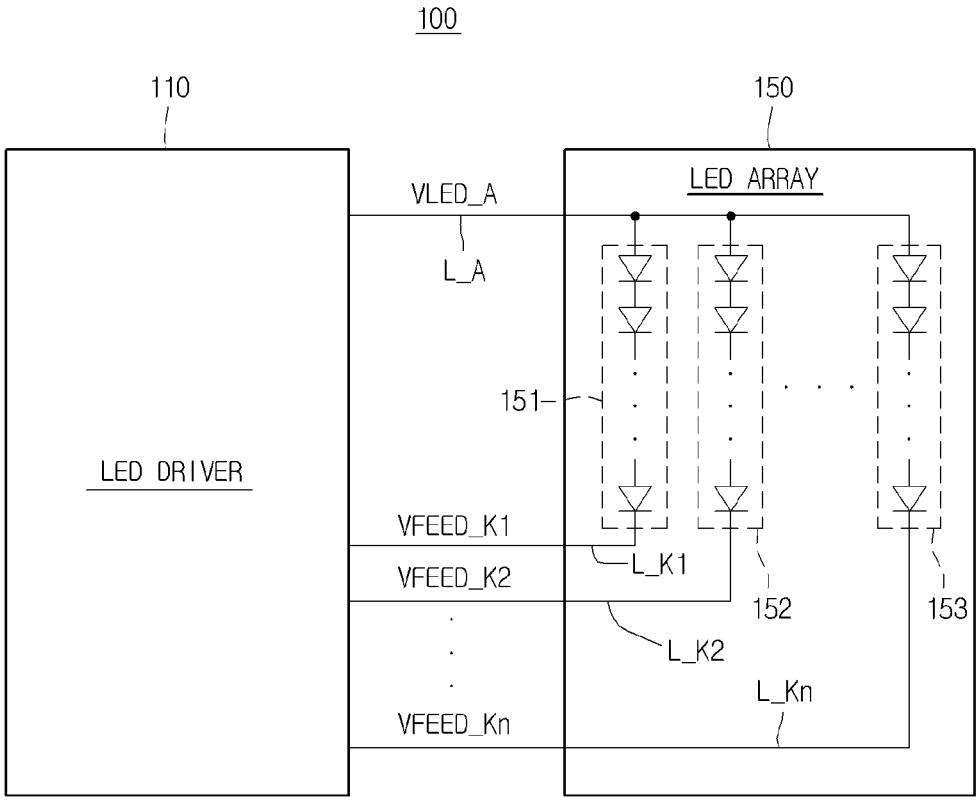
FIG. 1 is a block diagram showing an LED drive circuit according to an embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. In the drawings, the size, thickness and so on of a device can be exaggerated for convenience of explanation. Wherever possible, the same reference numbers will be used throughout this disclosure including the drawings to refer to the same or like parts.

Figure 2:
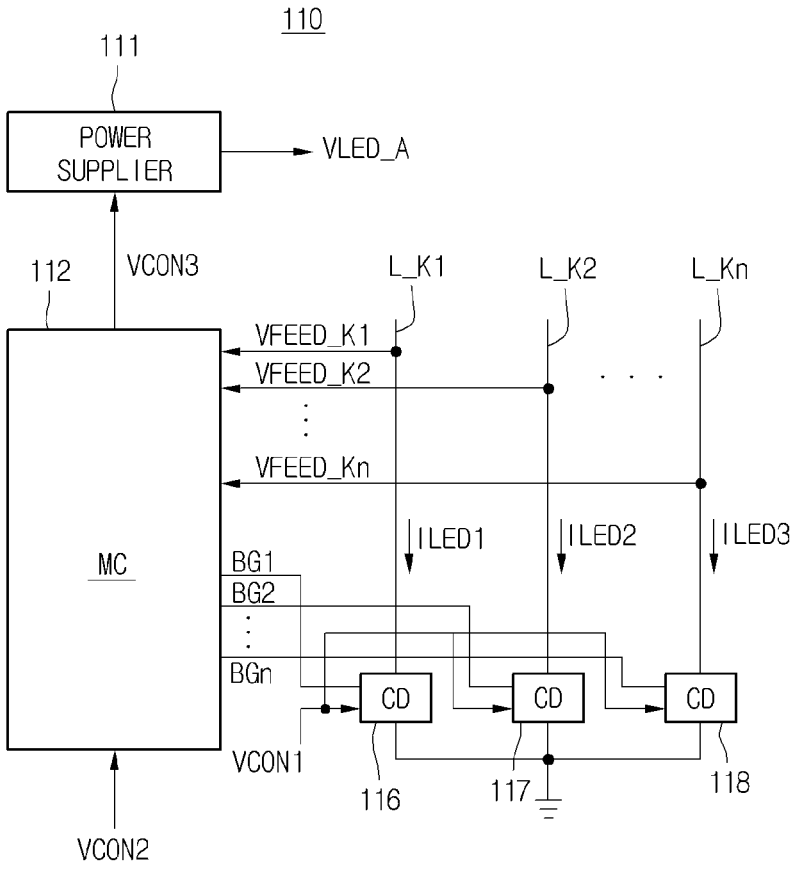
FIG. 2 is a detailed block diagram showing an LED driver and an LED array in FIG. 1.

FIG. 1 is a block diagram showing an LED drive circuit according to an embodiment of the present disclosure. FIG. 2 is a detailed block diagram showing an LED driver and an LED array in FIG. 1.

Referring to FIGS. 1 and 2, the LED drive circuit 100 according to an embodiment of the present disclosure includes an LED driver 110 and an LED array 150 configured with first through nth LED strings 151 through 153 which each include a plurality of serially connected LEDs. The LED strings 151 through 153 are connected parallel to one another.

The LED array 150 replies to an LED drive voltage VLED_A applied from the LED driver 110 and emits light. The LED driver 110 generates the LED drive voltage VLED_A and controls a voltage between both terminals of each power transistor to be adjusted. Also, the LED driver 110 controls currents flowing the first through nth LED strings 151 through 153 within the LED array 150 on the basis of LED current information.

The LED current information can be a target LED current adjustably set in the interior or exterior of a semiconductor integrated-circuit chip, which includes the LED driver, by a user. Currents flowing through the power transistors correspond to the currents flowing along the first to nth LED strings 151 to 153.

First terminals L_K1 through L_Kn of the LED strings 151 through 153 are connected to drain electrodes of the power transistors which are included in the LED driver 110, respectively. In FIG. 1, feedback voltages applied from the first terminals L_K1 through L_Kn to the LED driver 110 are shown as VFEED_K1 through VFEED_Kn, respectively. Currents flowing from the first terminals L_K1 through L_Kn to the drain electrodes of the power transistors within the LED driver 110 are represented as ILED1 through ILEDn, respectively. Meanwhile, second terminals of the LED strings 151 through 153 are connected to one another.

The LED driver 110 includes a power supplier 111, a main controller 112 and current drivers 116, . . . , 118.

The current drivers 116 through 118 are connected to the first through nth LED strings 151 through 153. Also, the current drivers 116 through 118 commonly reply to a first control signal VCON1 and control the LED current signals flowing along the respective LED strings 151 through 153. Although they are inserted in the drawings but explained, alphabet symbols of BG1, BG2, . . . , BGn indicate gate signals, which are applied to the transistors of the respective current drivers 116 through 118. If the gate signals BG1 through BGn have a high level, the LEDs on the LED strings 151 through 153 are turned-on. On the contrary, when the gate signals BG1 through BGn are in a low level, the LEDs on the LED strings are turned-off.

The main controller 112 generates a third control signal VCON3 on the basis of the feedback voltages VFEED_K1 through VFEED_Kn from the first terminals L_K1 through L_Kn of the LED strings 151 through 153 and a control signal VCON2. The second control signal VCON2 includes the LED current information. The third control signal VCON3 varies along the current signals which flow along the respective LED strings 151 through 153. Also, the third control signal VCON3 is applied from the main controller 112 to the power supplier 111.

The power supplier 111 replies to the third control signal VCON3 and generates the LED drive voltage VLED_A which is adjusted according to the third control signal VCON3. The LED drive voltage VLED_A is commonly applied to the second terminals L_A of the LED strings 151 through 153.

Figure 3:
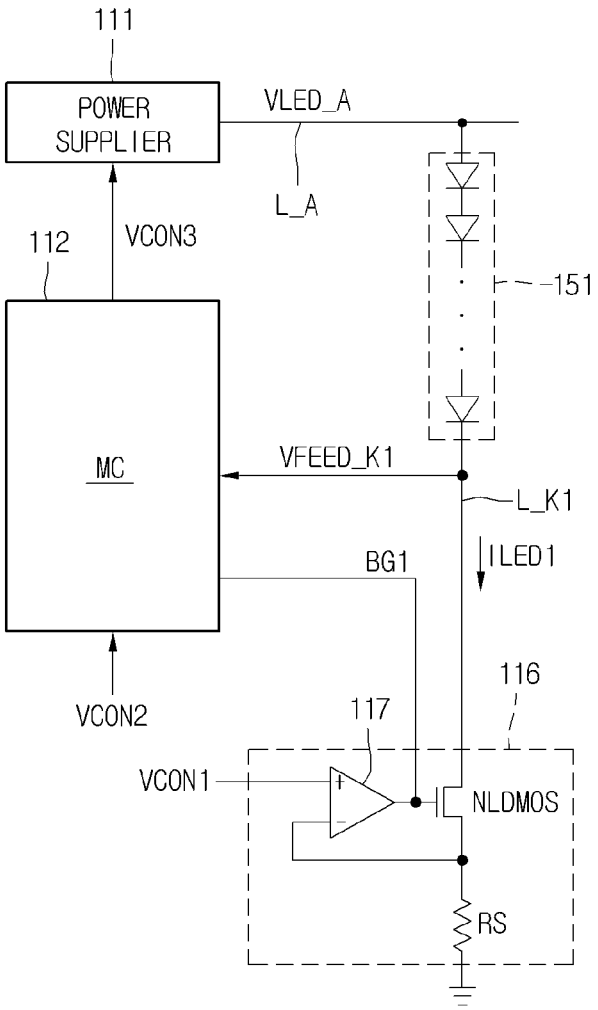
FIG. 3 is a detailed circuit diagram showing a main controller and a first LED string of the LED array in FIG. 2.

FIG. 3 is a detailed circuit diagram showing a main controller and a first LED string of the LED array in FIG. 2.

Referring to FIG. 3, a single current driver 116 is connected to the first LED string 151 of the LED drive circuit 100 which is shown in FIGS. 1 and 2.

As shown in FIG. 3, the current driver 116 of the LED driver 110 includes an amplifier 117, an n-type LDMOS (lateral diffused metal oxide semiconductor) transistor NLDMOS and a resistor RS.

The amplifier 117 can be a differential amplifier. The amplifier 117 amplifies the difference between a feedback signal and the first control signal VCON1 including the LED current information. The n-type LDMOS transistor NLDMOS includes a gate electrode connected to an output terminal of the amplifier 117, a drain electrode electrically connected to the first LED string 151, and a source electrode used to output the feedback signal. The resistor RS is connected between the source electrode of the n-type LDMOS transistor NLDMOS and a ground line, and used to determine the quantity of drain current of the n-type LDMOS transistor NLDMOS.

In FIG. 3, the n-type LDMOS transistor is used as a switching element, in order to form the current driver 116. However, an arbitrary power transistor such as a MOS power transistor, an IGBT (Insulated Gate Bipolar Transistor) or others can be used in the current driver 116 as a switching element.

The present embodiment enables the main controller 112 to periodically update a reference voltage, which is used to generate the third control signal VCON3, using the feedback drive voltages VFEED_K1 through VFEED_Kn and the gate signals applied to the transistors of the current drivers 116 through 118, as disclosed in the following description.

In other words, a reference voltage is periodically updated on the basis of the feedback drive voltages, which include noise components, from the LED strings 151 through 153. Also, the drive voltage is adjusted using the periodically adjusted reference voltage. Therefore, the LED drive circuit being hardly affected by the external environment can be implemented.

Figure 4:
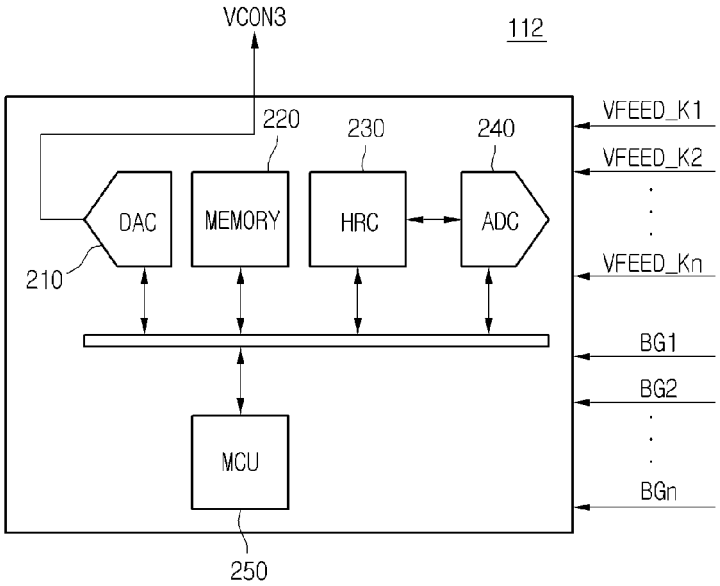
FIG. 4 is a detailed block diagram showing the configuration of a main controller in FIG. 2.

FIG. 4 is a detailed block diagram showing the configuration of a main controller in FIG. 2.

Referring FIGS. 1 and 4, the main controller 112 included in the LED drive circuit of the present embodiment continues to monitor the feedback drive voltages from the LED strings 151 through 153 which are arranged in the LED array 150. Also, the main controller 112 within the LED driver 110 internally and periodically updates the reference voltage.

This results from the fact that noise components caused by the external environment can be applied to the LED strings 151 through 153 of the LED array 150 at an arbitrary time point. In other words, in order to accurately generate the LED drive voltage, not only the feedback drive voltages with the noise components must be monitored but also the reference voltage must be updated on the basis of the monitored feedback drive voltages.

The main controller 112 includes a digital-to-analog converter (DAC) 210, a memory 220, a head room controller (HRC) 230, an analog-to-digital converter (ADC) 240 and a controller 250. The ADC 240 converts the feedback drive voltages with an analog shape into digital feedback drive voltages. The HRC 230 updates the reference voltage on the basis of the digital feedback drive voltages converted by the ADC 240, in order to compensate for the noise components included in the feedback drive voltages. Also, the HRC 230 adjusts a digital control signal, which is used to control the LED drive voltage, using the updated reference voltage. The DAC 210 converts the adjusted digital control signal into the third control signal VCON3 with an analog shape. The memory 220 stores information used to update the reference voltage and adjust the digital control signal. The controller 250 controls the elements of the main controller 112 including the DAC 210, the memory 220, the HRC 230 and ADC 240.

Figure 8:
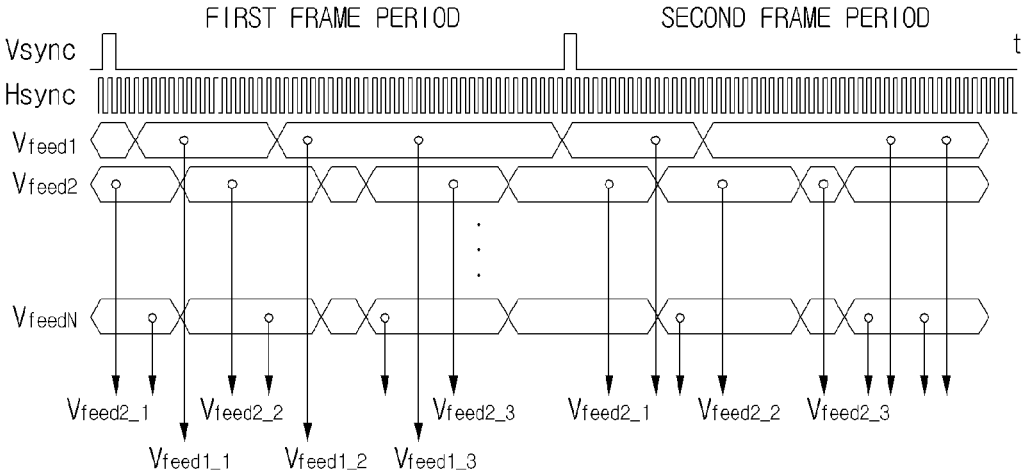
FIG. 8 is a waveform diagram illustrating the state that each of the feedback drive voltages from the LED strings is measured in irregular intervals by the drive voltage sampler of the head room controller within the main controller.

The main controller 112 continuously measures the feedback drive voltages VFEED_K1 through VFEED_Kn. However, the main controller 112 allows measuring time points to be irregularly set as shown in FIG. 8.

The feedback drive voltages VFEED_K1 through VFEED_Kn obtained by the above-mentioned way are converted into the digital feedback drive signal by means of the ADC 240. The digital feedback drive voltages are applied to the HRC 230 and used to update the reference voltage. The HRC 23 adjusts the digital control signal, which will be used to control the LED drive voltage applied to the LED array 150, on the basis of the updated reference voltage. The adjusted digital signal is applied to the DAC 210 and converted into the third control signal VCON3 with an analog shape. The third control signal generated in the DAC 210 of the main controller 112 is applied to the power supplier 111 and enables the LED drive voltage to be adjusted.

In this manner, not only the feedback drive voltages VFEED_K1 through VFEED_Kn are measured/obtained at the irregularly set time points but also the reference voltage is updated every frame period. As such, the LED drive voltage applied to the LED array 150 can be adjusted on the basis of the updated reference voltage and the measured feedback drive voltages VFEED_K1 through VFEED_Kn. Therefore, the LED drive circuit of the present embodiment can be stably driven even though the noise components are applied to the LED strings.

Figure 5:
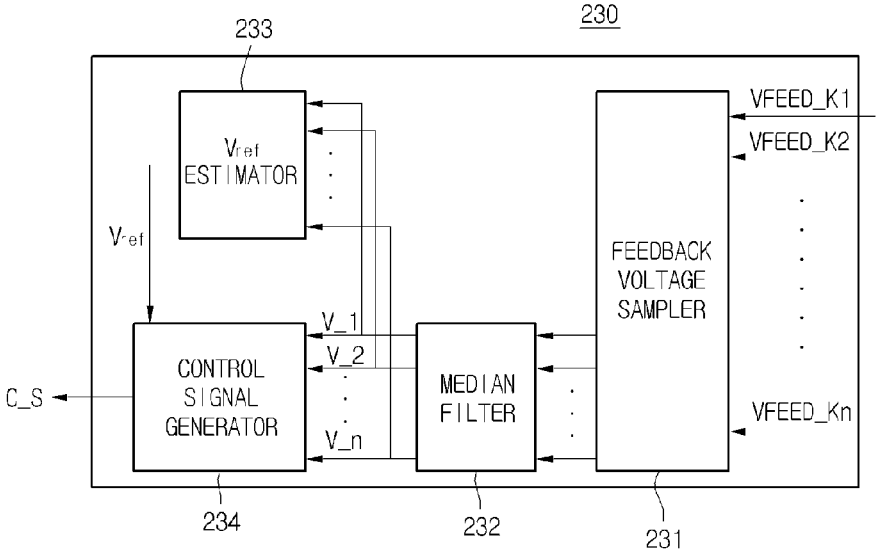
FIG. 5 is a detailed block diagram showing the configuration of a head room controller in FIG. 4.

FIG. 5 is a detailed block diagram showing the configuration of a head room controller in FIG. 4.

Referring to FIG. 5, the HRC 230 of the main controller 112 includes a feedback voltage sampler 231, a median filter 232, a reference voltage estimator 233 and a control signal generator 234. The feedback voltage sampler 231 samples multiple times each of the feedback drive voltages VFEED_K1 through VFEED_Kn from the LED strings of the LED array in irregular intervals, and sequentially applies a plurality of measurement values for each feedback drive voltage to the median filter 232. The median filter 232 inputting the plurality of measurement values for each feedback drive voltage from the drive voltage sampler 231 calculates an average value of the measurement values for each feedback drive voltage. The reference voltage estimator 233 derives a reference voltage Vref from the average values V_1, V_2, . . . , V_n for the feedback drive voltages VFEED_K1 through VFEED_Kn which are obtained by means of the average filter 232. The control signal generator 234 generates the digital control signal C_S using the reference voltage Vref generated in the reference voltage estimator 233 and the average values for the feedback drive voltages.

In the main controller 112 shown in FIG. 4, the HRC 230 receiving the digital feedback drive voltages from the ADC 240 performs multiple times a sampling operation for each of the digital feedback drive voltages VFEED_K1 through VFEED_Kn in the irregular intervals.

Each of the multiple sampling time points being irregularly performed for each of the digital feedback drive voltages VFEED_K1 through VFEED_Kn are set within the turned-on interval of the respective LED string corresponding to the high level interval of the respective gate signal.

As the plural measurement values for each the feedback drive voltages VFEED_K1 through VFEED_Kn applied from the LED strings, the median filter 232 calculates the average value of the plural measurement values for each feedback drive voltage VFEED_K, i.e., the average values V_1, V_2, . . . , V_n for the feedback drive voltages VFEED_K1 through VFEED_Kn.

The reference voltage estimator 233 derives the reference voltage Vref from the average values for the feedback drive voltages which are obtained by the median filter 232.

Then, the control signal generator 234 generates a digital control signal C_S responding to the LED drive, voltage which is be adjusted, using the reference voltage Vref obtained by the reference voltage estimator 233 and the average values V_1 through V_n for the feedback drive voltages VFEED_K1 through VFEED_Kn. The digital control signal C_S may be generated through an updating procedure shown in FIG. 7.

Figure 6:
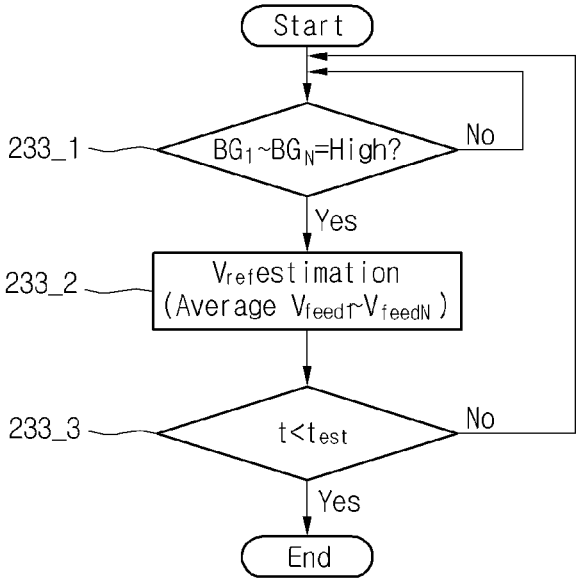
FIG. 6 is a flow chart illustrating the operation of a reference voltage calculator of the head room controller in FIG. 5.
Figure 7:
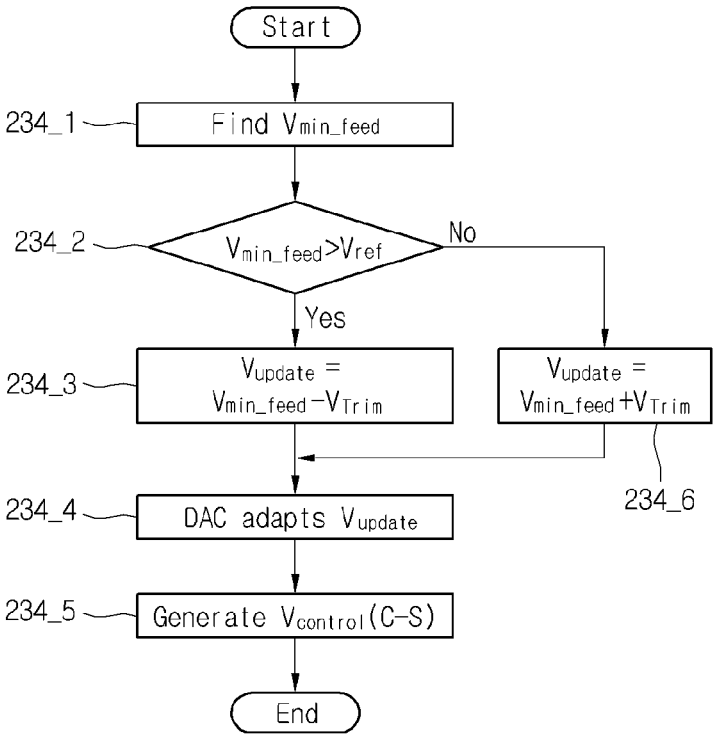
FIG. 7 is a flowchart illustrating a procedure being performed by the main controller of FIG. 2 for updating a drive voltage, which is used to drive the LED array.

FIG. 6 is a flow chart illustrating the operation of a reference voltage calculator of the head room controller in FIG. 5. FIG. 7 is a flow chart illustrating a procedure being performed by the main controller of FIG. 2 for updating a drive voltage, which is used to drive the LED array.

Referring to FIG. 6, the reference voltage estimator 233 in FIG. 5 checks the level states of the gate signals BG1~BGn applied to the transistors of the current drivers 116 through 118 in FIG. 2 (Step 233_1). If the gate signals BG1~BGn have a high level, the reference voltage estimator 233 calculates the reference voltage Vref using the average values V_1 through V_n for the feedback drive voltages which are obtained by the median filter 232 (Step 233_2). On the contrary, when the gate signals BG1~BGn maintain the low level, the reference voltage estimator 233 is in standby mode until the gate signals go into the high level.

After the step 233_2, the reference voltage estimator 233 checks whether or not a test time lapsed (Step 233_3). If it is determined that the test time lapsed, the reference voltage estimator 233 terminates the calculation of the reference voltage Vref. On the contrary, if the test time is not expired, the reference voltage estimator 233 returns to the step 233_1. In other words, the reference voltage estimator 233 repeatedly performs the calculation of the reference voltage Vref during the test time set by a user.

Similarly to the reference voltage estimator 233, the median filter 232 also repeatedly performs the average value calculation for the plural measurement values of each feedback drive voltage during an arbitrary test time set by a user (Step 233_3).

The flow chart of FIG. 7 illustrates a procedure generating a digital control signal C_S, which is used to adjust the LED drive voltage for the LED array, using the feedback drive voltages with the noise components from the LED strings, as an example. As such, the digital control signal C_S can be generated in a variety of processing manners according to the function of each element with the main controller.

Referring to FIGS. 4, 5 and 7, the control signal generator 234 within the HRC 230 selects the least feedback drive voltage Vmin_feed among the feedback drive voltages from averaged by the median filter 232 (Step 234_1). Also, the control signal generator 234 compares the least feedback drive voltage Vmin_feed with the reference voltage Vref calculated by the reference voltage estimator 233 (Step 234_2).

If the least feedback drive voltage Vmin_feed is higher than the reference voltage Vref, the control signal generator 234 sets the difference between the least feedback drive voltage Vmin_feed and an invariable voltage Vtrim to be an updated drive voltage Vupdate (Step 234_3). The invariable voltage Vtrim can be arbitrarily set by a user.

On the contrary, when the least feedback drive voltage Vmin_feed is lower than the reference voltage Vref, the control signal generator 234 sets the sum of the least feedback drive voltage Vmin_feed and the invariable voltage Vtrim to be the updated drive voltage Vupdate (Step 234_6). This results from the fact that the least feedback drive voltage Vmin_feed being lower than the reference voltage Vref indicates that the current LED drive voltage is considerably lowered.

The updated drive voltage Vupdate is applied to the DAC 210 within the main controller 112 as a digital control signal C_S (Step 234_4). The DAC 210 converts the digital control signal C_S into the third control signal VCON3 with an analog shape (Step 234_5).

The third control signal VCON3 is applied from the main controller 112 to the power supplier 111 as shown in FIG. 3. The power supplier 111 adjusts the LED drive voltage VLED_A according to the third control signal VCON3 and applies the adjusted LED drive voltage VLED_A to the LED array 150.

FIG. 8 is a waveform diagram illustrating the state that each of the feedback drive voltage from the LED strings is measured multiple times in irregular intervals by the drive voltage sampler of the head room controller within the main controller.

As seen from FIG. 8, each of the feedback drive voltages is sampled multiple times in irregular intervals by means of the drive voltage sampler within the HRC 230 while the gate signals BG1~BGn applied to the current drivers which are connected to the respective LED strings have a the high level, that is, the LED strings are turned-on.

In detail, the first feedback drive voltage Vfeed1 from the first LED string can be sampled by the drive voltage sampler 231 at a time point when 10, 20 or 53 horizontal synchronous pulses Hsync are counted, during a first frame period. Similarly, each of the second through nth feedback drive voltages Vfeed2 through Vfeedn applied from the second through nth LED strings can be sampled in irregular intervals by means of the drive voltage sampler 231.

In this way, the HRC 230 calculates the reference voltage Vref and the average values for the feedback drive voltages based on the sampled values for each feedback drive voltage, which are obtained in the irregular intervals by the drive voltage sampler 231, and updates the LED drive voltage VLED_A applied to the LED array.

As described above, the LED drive circuit and method of the embodiments allow not only the reference voltage to be periodically updated on the basis of the feedback drive voltages but also the drive voltage control signal to be generated using the updated reference voltage, in order to adjust the LED drive voltage applied to the LED array. Therefore, the LED drive circuit being hardly affected by the external environmental noise can be implemented.

Also, the drive voltage control signal is generated in the state that the sampling time points for each of the feedback drive voltages from the plurality of LED strings within the LED array are irregularly set. Therefore, the LED drive circuit of the present embodiment can be stably driven regardless of the external environmental noise.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A light-emitting diode drive circuit comprising:

a light-emitting diode array configured to include light-emitting diode strings which each include a plurality of serially connected light-emitting diodes;

a power supplier configured to apply a drive voltage to the light-emitting diode array;

current drivers connected to the respective light-emitting diode strings and configured to control current signals flowing along the respective light-emitting diode strings in response to a first control signal including light-emitting diode current information; and a main controller configured to irregularly input each feedback drive voltage from the light-emitting diode strings and generate a second control signal which is used to adjust to the drive voltage applied from the power supplier to the light-emitting diode array.

2. The light-emitting diode drive circuit of claim 1, wherein the main controller includes:

an analog-to-digital converter configured to convert the feedback drive voltages from the light-emitting diode strings into digital signals;

a head room controller configured to irregularly input each of the digital feedback drive voltages from the analog-to-digital converter and generate a digital control signal;

a digital-to-analog converter configured to convert the digital control signal from the head room controller into the second control signal corresponding to an analog signal;

a memory into which information necessary to generate the second control signal is stored; and a controller configured to control the analog-to-digital converter, the head room controller, the digital-to-analog converter and the memory.

3. The light-emitting diode drive circuit of claim 2, wherein the head room controller includes:

a drive voltage sampler configured to sample multiple times each of the digital feedback drive voltages from the analog-to-digital converter in irregular intervals;

a median filter configured to calculate an average value of the multiple samples for each of the feedback drive voltages; and a reference voltage estimator configured to periodically update a reference voltage using the average values of the feedback drive voltages applied from the median filter.

4. The light-emitting diode drive circuit of claim 3, wherein the head room controller further includes a control signal generator configured to generate the digital control signal, which is used to adjust the drive voltage being generated in the power supplier, using the reference voltage from the reference voltage estimator and the average values of the digital feedback drive voltages from the median filter.

5. The light-emitting diode drive circuit of claim 1, wherein the main controller generates the second control signal being used in the adjustment of the drive voltage when gate signals applied to the current drivers have a high level.

6. A method of driving a light-emitting diode drive circuit which includes a light-emitting diode array configured to include light-emitting diode strings each having a plurality of serially connected light-emitting diodes, a power supplier configured to apply a drive voltage to the light-emitting diode array, and current drivers connected to the respective light-emitting diode strings and configured to control current signals flowing along the respective light-emitting diode strings in response to a first control signal including light-emitting diode current information, the method comprising:

measuring multiple times a feedback drive voltage from each of the light-emitting diode strings in irregular intervals;

calculating an average value of the measured multiple signals for each of the feedback drive voltages to generate average values of the feedback drive voltages;

periodically updating a reference voltage using the average values of the feedback drive voltages applied from the median filter; and generating a second control signal, which is used to adjust the drive voltage being applied from the power supplier to the light-emitting diode array, using the updated reference voltage and the average values of the digital feedback drive voltages.

7. The method of claim 6, further comprises detecting whether gate signals being applied to the current drivers have any one of high and low levels.

8. The method of claim 7, wherein the second control signal used to adjust the drive voltage applied to the light-emitting diode array is generated when the gate signals being applied to the current drivers have the high level.

9. The method of claim 6, wherein the measurement of the feedback drive voltages includes:

converting the feedback drive voltages from the light-emitting diode strings into digital signals; and sampling multiple times each of the digital feedback drive voltages in the irregular intervals.

10. The method of claim 9, wherein the calculation of the average values calculates an average value of the multiple samples for each the feedback drive voltages using a median filter.

11. The method of claim 9, wherein the measurement of the feedback drive voltages enables measuring time points of the feedback drive voltages to be differently set every period.

* * * * *